US006557704B1

(12) United States Patent
Randolph

(10) Patent No.: US 6,557,704 B1
(45) Date of Patent: May 6, 2003

(54) ARRANGEMENT FOR PORTABLE PUMPING UNIT

(75) Inventor: Larry Tab Randolph, San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

(21) Appl. No.: 09/658,610

(22) Filed: Sep. 8, 2000

Related U.S. Application Data

(60) Provisional application No. 60/152,760, filed on Sep. 8, 1999.

(51) Int. Cl.[7] ..... B65D 83/10; B65D 81/02

(52) U.S. Cl. ..... 206/363; 206/589; 417/476; 418/45

(58) Field of Search ..... 206/363, 364, 206/370, 438, 439, 570, 572, 305, 320, 588, 590, 592, 594; 220/378, 795, 806, 849, 4.26; 128/898; 600/580, 581; 417/476; 418/45

(56) References Cited

U.S. PATENT DOCUMENTS 1,986,057 A * 1/1935 Hackworth ..... 220/849
3,251,460 A * 5/1966 Edmonds ..... 220/4.26
3,908,657 A * 9/1975 Kowarski ..... 600/580
4,008,717 A * 2/1977 Kowarski ..... 600/580
4,416,595 A * 11/1983 Cromie ..... 417/476
4,479,762 A * 10/1984 Bilstad et al. ..... 417/395
4,504,200 A * 3/1985 Olson ..... 417/476
4,671,943 A * 6/1987 Wahlquist ..... 206/363
D434,150 S * 11/2000 Tumey et al. ..... D24/169

* cited by examiner

*Primary Examiner*—Bryon P. Gehman

(57) ABSTRACT

An enclosure for a medical pumping device generally comprises a front shell, a back shell and a polymeric substrate interposed therewith. The polymeric substrate comprises at least one gasket seat corresponding to the perimetric edge of each shell. In use, various components are securely placed within the plurality of component compartments within the polymeric substrate and thereafter encased within the enclosure between the front shell and back shell. According to the preferred embodiment of the present invention, the polymeric substrate also serves to form bumpers about the edges of the enclosure when the shells and substrate are assembled together.

14 Claims, 1 Drawing Sheet

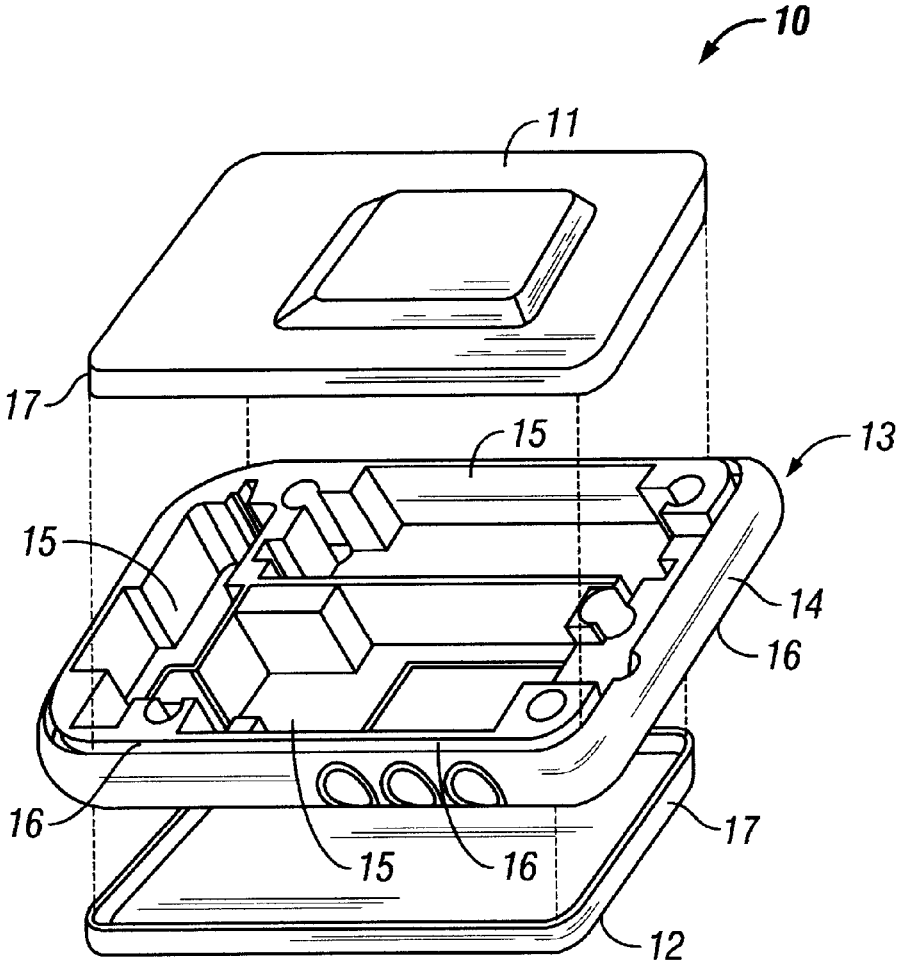
10
11
17
15
13
15
14
16
16
15
16
17
12

ARRANGEMENT FOR PORTABLE PUMPING UNIT

RELATED APPLICATION INFORMATION

This Application claims the benefit of U.S. Provisional Patent Application Serial No. 60/152,760 filed Sep. 8, 1999. This Application claims domestic priority under 35 U.S.C. §119(e)(1).

FIELD OF THE INVENTION

This present invention relates generally to wound healing. More specifically, the present invention relates to an arrangement of components for a portable pump of the type for use with a gradient pressure compression bandage adapted for treating ulcers and the like in mammalian extremities, particularly venous stasis ulcers and edema.

BACKGROUND OF THE INVENTION

An ulcer is commonly defined as a lesion on the surface of the skin, or on a mucous surface, manifested through a superficial loss of tissue. Ulcers are usually accompanied by inflammation and often become chronic with the formation of fibrous scar tissue in the floor region. Chronic ulcers are difficult to heal; they almost always require medical intervention and, in many cases, lead to amputation of the limb upon which they occur.

In general, ulcers may be attributed to any of a variety of factors reducing superficial blood flow in the affected region. Leg ulcers, in particular, are attributable to congenital disorders, external injury, infections, metabolic disorders, inflammatory diseases, ischaemia, neoplastic disorders and, most commonly, arterial disease, neuropathic disorders and venous insufficiency. Although certainly not exhaustive, the table entitled Common Etiology of Leg Ulcers highlights the frequency at which patient's are placed at risk for the formation of this potentially devastating disease.

Common Etiology of Leg Ulcers

| | |
|---|---|
| Congenital: | Absence of valves, chromosomal disorders, Klinefelter's syndrome, connective tissue defects affecting collagen and elastic fibers, arteriovenous aneurysms, prolidase deficiency. |
| External Injury: | Laceration, contact dermatitis, Decubitus, inoculation (drug addiction), burns, cold, irradiation. |
| Infections: | Viral, bacterial fungal. |
| Metabolic Disorders: | Diabetes mellitus, colonic stasis from sugar/fats. |
| Inflammatory Diseases: | Vasculitus, pyoderma gangrenosum, rheumatoid arthritis, panniculitus. |
| Ischaemia: | Peripheral vascular disease, embolus, scleroderma hypertension, sickle-cell anemia. |
| Neoplastic Disorders: | Skin neoplasms, leukemia. |
| Neuropathic Disorders: | Spina bifida, leprosy, diabetes, mellitus, neuropathy syringomyelia. |
| Venous Insufficiency: | Poster (prolonged standing, legs crossed, long legs), abdominal pressure (tumor, pregnancy), employment, physical activity (apathy, paralysis, osteoarthritis), effort (weight lifting), deep vein thrombosis (50% tibial fractures, 25% abdominal surgery, 25% myocardial thrombosis, 50% strokes), blood stasis, hemolytic anemias. |

Perhaps as striking as the incidence of this disease, is the magnitude of the resources dedicated to the combat of their occurrence. It is estimated that leg ulcers cost the U.S. healthcare industry in excess of $1 billion annually in addition to being responsible for over 2 million annual missed workdays. Unfortunately, the price exacted by ulcers is not merely financial. Leg ulcers are painful and odorous open wounds, noted for their recurrence. Most tragic, diabetic ulcers alone are responsible for over 50,000 amputations per year. As alarming as are these consequences, however, the basic treatment regimen has remained largely unchanged for the last 200 years. In 1797, Thomas Baynton of Bristol, England introduced the use of strips of support bandages, applied from the base of the toes to just below the knee, and wetting of the ulcer from the outside. As discussed in more detail herein, versions of this therapy remain the mainstay treatment to this day and, clearly, any improvement is of critical importance.

As noted above, the most common causes of leg ulcers are venous insufficiency, arterial disease, neuropathy, or a combination of these problems. Venous ulcers, in particular, are associated with abnormal function of the calf pump, the natural mechanism for return to the heart of venous blood from the lower leg. This condition, generally referred to as venous insufficiency or venous hypertension, may occur due to any of a variety of reasons, including damage to the valves, congenital abnormalities, arteriovenous fistulas, neuromuscular dysfunction, or a combination of these factors. Although venous ulcers tend to be in the gaiter area, usually situated over the medial and lateral malleoli, in severe cases the entire lower leg can be affected, resembling an inverted champagne bottle. While the exact pathologic relationship between venous insufficiency and venous ulcers remains largely unknown, distinct modalities for both prevention and treatment have nonetheless been developed.

Clinical modalities for prevention of venous ulcers generally focus on the return of venous blood from the lower extremities to the heart. Mechanical prophylaxes are widespread in the area of prevention and are often referred to as foot pumps or wraps, leg pumps or wraps and sequential compression devices, all of which function to prevent deep vein thrombosis ("DVT"), a common precursor to venous stasis ulcers. An exemplar foot pump is commercially available from Kinetic Concepts, Inc. of San Antonio, Tex. under the trademark "PLEXIPULSE." An exemplary sequential compression device is described in U.S. Pat. No. 5,031,604 issued Jul. 16, 1991 to Dye ("Dye").

As generally described in Dye, mechanical prophylaxes for DVT prevention are directed toward the improvement of venous return. To this end, devices like that of Dye are adapted to take advantage of the naturally occurring valvular structure of the veins to squeeze blood from a patient's limb. For instance, the trademark "PLEXIPULSE" device is adapted to intermittently compress the patient's plantar venous plexus, promoting the return of blood from the patient's foot upward and through the calf region. Likewise, and as generally described at column 2, lines 33 et seq. of Dye, leg compression devices are usually adapted to squeeze the patient's leg first near the ankle and then sequentially upward toward the knee. This milking-type sequence may or may not be performed on a decreasing pressure gradient, but is always designed to move blood from the extremity toward the heart.

Treatment for venous ulcers, on the other hand, is predominately centered about gradient compression, through bandaging, and leg elevation. Although it is not precisely known how or why they improve venous ulcer healing, compression therapies, specifically including compression bandaging techniques, are now the well-established mainstay for the treatment of venous stasis and other ulcers. In fact, it is generally undisputed that compression bandaging is the most efficacious method of wound healing, often resulting in overall improvement of the patient's quality of life.

Among the predominant theories explaining the effects of compression bandaging, edema reduction and control stand out. It is thought that the reduction and control of edema improves capillary microcirculation, in turn resulting in the elimination of venous ulcers. Another popular theory holds that reactive hyperemia is responsible for the success of compression bandaging. According to this theory, the arrest and subsequent restoration of blood flow to the affected region, known as Bier's method, results in an ultimately increased presence of blood in the region. Regardless of the theory adopted, however, it is important to note that it is universally understood that a proper gradient must be established in order to obtain the benefits of compression bandaging. This gradient is generally accepted as being from about 35 to 45 mm Hg at the ankle and reducing to about 15 to 20 mm Hg at just below the knee. Often stated in the literature as a prerequisite to good bandaging technique, the maintenance of graduated compression is critical to effective treatment of ulcers. Failure to initially obtain, and thereafter maintain, the desired sub-bandage pressures is fatal to the treatment regimen.

The criticality of establishing and maintaining the desired sub-bandage pressure directly results in significant disadvantages, associated with the application of compression bandaging in general, and serious hazards to the patient, associated with the misapplication of bandaging specifically. In particular, proper bandaging under the presently known methods requires a highly skilled caregiver in order to establish the desired sub-bandage pressures. Once established, however, the pressure gradient is difficult to monitor. In fact, the sub-bandage pressure is usually only monitored to the extent that the caregiver either observes or fails to observe a reduction in edema. This is particularly disturbing when one considers that it is to be expected that as properly applied bandaging performs its intended function, edema will be reduced causing, in effect, the bandage to become loosened to a state of improper application whereafter edema will likely increase. More disturbing is the fact that over tightening of the bandage places the patient at direct risk for skin necrosis and gangrene, especially if the patient has arterially compromised limbs.

Unfortunately, there has been surprisingly little development in treatment protocols directed toward better achieving desired sub-bandage pressures. Even though the foregoing discussion highlights the necessity for frequent readjustment, or even reapplication of the bandaging, the presently available treatment modalities are very difficult to apply. One common type of bandaging comprises four layers, including an orthopedic wool layer, a crepe bandage layer and two compression layers. The compression layer bandages are often provided with imprinted rectangles that become square upon achieving the correct tension. Although helpful, only two sets of markings are typically provided—one for normal size ankles and one for larger, and no provision is made for adaptation to changes in the level of edema. Another common treatment modality is the compression dressing—an elastic support stocking providing a compression of about 30 to 40 mm Hg. These stockings, however, are often impractical for elderly patients or patients with arthritis who may find them difficult to put on the leg. For the patient with large or exudative ulcers, which require frequent dressing changes, compression stockings are also thought to be prohibitively impractical. As this discussion makes apparent, the need for treatment modalities beyond the presently known compression bandaging techniques is great.

Unfortunately, the mechanical prophylaxes utilized in prevention therapies are not generally extendable to wound healing. Recent reports have indicated that achieving sustained sub-bandage pressures near 40 mm Hg may be more efficacious in providing timely wound healing than lower pressure levels. Additionally, Applicant has found that mechanical prophylaxes are generally better able to deliver higher pressures. However, caution is warranted. Because some 20 percent or more of patients with venous ulcers may also have some degree of co-existing lower extremity arterial disease, it is important to clarify the possible impact of higher levels of compression bandaging on lower extremity skin circulation. Studies show that mechanically produced compression levels may produce ischaemic effects not noted at similar compression levels obtained through bandaging. The reductions in leg pulsatile blood flow associated with mechanical prophylaxes often occur at compression levels below that necessary for good bandaging effects. This result, sometimes called cuffing, has resulted in most mechanical prevention prophylaxes being contraindicated for patients exhibiting DVT. Consequently, those of ordinary skill in the art have until very recently steadfastly avoided mechanical prophylaxes for the treatment of venous stasis and other ulcers or edema of the extremities.

The end result has been that the patient once suffering from leg ulcers was left at the mercy of an extraordinarily high recurrence rate and in many cases is still thought to be at severe risk for eventual amputation. This leads to emotional complication of the treatment process. Because preventing recurrence is as great a challenge as healing the ulcer, new and improved methods and apparatus for treatment of leg ulcers continue to be desperately needed. In particular, because careful skin care and compression therapy must continue throughout the patient's lifetime, it is imperative to the patient's long-term health care to provide a low-cost, easily applied solution with which the patient may be assured of receiving effective therapy. In addition, it is imperative that the implemented solution go as far as possible toward allowing the patient to regain a relatively normal lifestyle. To this end, it is a primary object of the present invention to overcome many of the shortcomings of the prior art to provide a mechanical prophylaxis for the administration of gradient compression therapy whereby the patient may return to a relatively normal regimen. In Applicant's copending U.S. patent application Ser. No. 09/259,040 filed Feb. 26, 1999, which by this—reference is incorporated herein as though now set forth in its entirety, Applicant describes its efforts to maximize patient mobility by reducing the need for the patient to be located at any particular place in order to receive therapy. In particular, Applicant discloses structure intended to provide a prophylactic device in a lightweight, readily transportable and non-intrusive package. In this manner, the described invention is directed toward improved patient compliance, ultimately resulting in improved long-term outcome—both physically and emotionally.

It is a further object of the present invention, however, to extend upon the teachings of Applicant's prior application by providing an arrangement for the previously described components wherein certain drawbacks affecting patient compliance and device portability are eliminated. In particular, it is an object of the present invention to provide a portable pump for use with a gradient compression bandage, or similar medical device, that is substantially watertight, lightweight, soundproof and easy to assemble. Further, it is an object of the present invention to provide such a pump wherein the arrangement also serves to reduce vibrations, thereby increasing comfort to a wearer. Additionally, many other problems, obstacles and challenges present in existing modalities for the treatment of leg ulcers will be evident to caregivers and others of ordinary skill in the art. Many of these will be readily recognized as being overcome by the teachings set forth herein.

SUMMARY OF THE INVENTION

In accordance with the foregoing objects, the present invention—an enclosure arrangement for a portable pump adapted for use with a gradient pressure compression bandage—generally comprises a package for a selectively actuable source of pressurized fluid in communication with a plurality of outlets; a plurality of selectively actuable latching valves interposed between the fluid source and each outlet; and a controller for controlling electrical power supplied to the fluid source and the latching valves. The packaged components are as described in Applicant's copending U.S. patent application Ser. No. 09/259,040, which has been incorporated herein and it is to be understood that the enclosure arrangement now described is described with reference to those components. This is a matter of convenience, however, and those of ordinary skill in the art will recognize that the novel arrangement described may be performed with other components that may or may not be substantial equivalents of the previously described components.

As described in the prior application, the fluid source preferably comprises a miniature diaphragm air compressor. Although, in the preferred embodiment, the controller comprises an electrical circuit adapted to selectively switch power to the air compressor and the latching valves as required, these components can nonetheless produce noticeable vibration during operation if mounted to a chassis as now common in the art. According to the present invention, these and other components arc housed in a polymeric bed interposed between a front shell and a back shell of the pump enclosure. In this manner, the enclosure itself replaces the previously utilized metal chassis, resulting in a lighter weight design wherein vibrations from the housed components to and between the front shell and back shell of the enclosure are discoupled and thereby reduced. This arrangement also results in increased protection for the housed components against shock from accidental drop or the like. Also according to the preferred embodiment of the present invention, the polymeric bed extends outward and between the perimetrical edges of the front and back shells to form a gasket therebetween. This feature further contributes to vibration discoupling as well as promoting water and soundproofing. Still further, it is found that this arrangement results in fast and easy assembly, thereby contributing to the reduced costs desirable in a home care medical device.

Finally, many other features, objects and advantages of the present invention will be apparent to those of ordinary skill in the relevant arts, especially in light of the foregoing discussions and the following drawings and exemplary detailed description.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein the FIGURE shows, in exploded perspective view, the enclosure arrangement of the preferred embodiment of the present invention.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims which may be drawn hereto.

Referring to the FIGURE, the enclosure 10 for a gradient compression system's portable pump, or other similar portable medical device, is detailed. As shown, the enclosure 10 generally comprises a front shell 11, a back shell 12 and a polymeric substrate 13 interposed therewith. As also shown in the FIGURE, the polymeric substrate 13 comprises at least one gasket seat 16 corresponding to the perimetric edge 17 of each shell 11, 12. In use, various components, such as those described in Applicant's copending U.S. patent application Ser. No. 09/259,040 which has been incorporated herein, are securely placed within a plurality of component compartments 15 within the polymeric substrate 13 and thereafter encased within the enclosure 10 between the front shell 11 and back shell 12. According to the preferred embodiment of the present invention, the polymeric substrate 13 also serves to form bumpers 14 about the edges of the enclosure 10 when the shells 11, 12 are closed about the gasket seats 16.

Applicant has found that the polymeric substrate 13 may be inexpensively and easily mass-produced through resin injection molding. Those of ordinary skill in the art, however, will recognize that many other substantially equivalent methods may be utilized to produce such a substrate 13. It is only critical that the substrate 13 produce a firm grip about the components housed within the compartments 15 and that the discoupling gasket function be recreated. In this manner, the components are securely held within the enclosure 10, but the need for screws, heavy chassis structures and the like is eliminated. This simplifies manufacture, contributes to overall cost and weight reduction, leads to a soundproof and watertight structure and extends product life by providing increased protection for the housed components and eliminating failure due to vibration loosening of mounting and other hardware.

While the foregoing description is exemplary of the preferred embodiment of the present invention, those of ordinary skill in the relevant arts will recognize the many variations, alterations, modifications, substitutions and the like as are readily possible, especially in light of this description and the accompanying drawing. For example, those of ordinary skill in the art will recognize that the described enclosure 10 is also well suited to streamline repair operations, wherein the shells 11, 12 are simply disengaged and defective components removed from the respective compartments 15 for repair and/or replacement. In any case, because the scope of the present invention is much broader than any particular embodiment, the foregoing detailed description should not be construed as a limitation of the scope of the present invention, which is limited only by the claims that may be drawn hereto.

What is claimed is:

1. A portable device adapted to define an enclosure for housing pump components, the device comprising:

a front shell having a first perimetric edge, a back shell having a second perimetric edge, and a substrate shaped to fit interposed between the front and back shells, the substrate defining a plurality of compartments adapted to produce a firm grip about the pump components to hold the same securely in place within the enclosure, the substrate further including gasket seats adapted to mate with the perimetric edges of the front and back shells.

2. The portable device of claim 1 wherein said substrate is comprised of a polymeric material.

3. The portable device of claim 2 wherein the gasket seat extends beyond said perimetric edges.

4. The portable device of claim 3 wherein said components are additionally placed within compartments fabricated on said front shell or said back shell.

5. The portable device of claim 2 wherein said components are additionally placed within compartments fabricated on said front shell or said back shell.

6. The portable device of claim 2 wherein the polymeric substrate is produced through resin injection molding.

7. The portable device of claim 1 wherein the gasket seat extends beyond said perimetric edges.

8. The portable device of claim 7 wherein said components are additionally placed within compartments fabricated on said front shell or said back shell.

9. The portable device of claim 1 wherein said components are additionally placed within compartments fabricated on said front shell or said back shell.

10. The portable device of claim 1 wherein the substrate is operable to substantially dampen vibrations transmitted to the device.

11. The portable device of claim 1 wherein the device is substantially watertight.

12. A portable pump assembly adapted for use with a gradient pressure compression bandage comprising:

a front shell and a back shell, the front shell having a first perimetric edge, and the back shell having a second perimetric edge;

a plurality of pump components; and a substrate shaped to fit interposed between the front and back shells, the substrate defining a plurality of compartments adapted to produce a firm grip about the pump components to hold the same securely in place within the substrate, the substrate further including gasket seats adapted to mate with the perimetric edges of the front and back shells.

13. The portable pump assembly of claim 12 wherein said substrate is comprised of a polymeric material.

14. A substantially watertight portable pump assembly adapted for use with a gradient pressure compression bandage comprising:

a front shell and a back shell, the front shell having a first perimetric edge, and the back shell having a second perimetric edge;

a plurality of pump components; and a resin injection molded polymeric substrate shaped to fit interposed between the front and back shells, the substrate defining a plurality of compartments adapted to produce a firm grip about the pump components to hold the same securely in place within the substrate, the substrate further including gasket seats adapted to mate with the perimetric edges of the front and back shells, the gasket seats being operable to substantially dampen vibrations transmitted to the portable pump assembly.

* * * * *